US006024618A

United States Patent [19]

Makishima et al.

[11] Patent Number: 6,024,618

[45] Date of Patent: Feb. 15, 2000

[54] METHOD OF OPERATING ELECTRON TUBE

[75] Inventors: Hideo Makishima; Hisashi Takemura, both of Tokyo, Japan

[73] Assignee: NEC Corporation, Tokyo, Japan

[21] Appl. No.: 09/238,412

[22] Filed: Jan. 28, 1999

[30] Foreign Application Priority Data

Feb. 12, 1998 [JP] Japan ..... 10-029731

[51] Int. Cl.[7] ..... H01J 9/02

[52] U.S. Cl. ..... 445/6

[58] Field of Search ..... 445/6

[56] References Cited

U.S. PATENT DOCUMENTS 5,658,180 8/1997 Takagi ..... 445/6

FOREIGN PATENT DOCUMENTS 6-223706 8/1994 Japan .
7-14501 1/1995 Japan .
9-265896 10/1997 Japan .

*Primary Examiner*—Kenneth J. Ramsey
*Attorney, Agent, or Firm*—Young & Thompson

[57] ABSTRACT

In a method of operating an electron tube including a plurality of emitters formed on a substrate and having sharp tips, gate electrodes surrounding the plurality of emitters, and a peripheral electrode surrounding an electron emission region constituted by the plurality of emitters and the gate electrodes and insulated from the plurality of emitters and the gate electrodes, the voltage applied to the peripheral electrode is set to be lower than the voltage applied to the gate electrode.

6 Claims, 7 Drawing Sheets

METHOD OF OPERATING ELECTRON TUBE

BACKGROUND OF THE INVENTION

1. Field of the Invention

The present invention relates a method of operating an electron tube and, more particularly, to a method of operating a cold-cathode-equipped electron tube in the process of manufacturing the tube.

2. Description of the Prior Art

In the process of manufacturing a cathode ray tube equipped with a field emission cathode, in the "cathode activation step" of extracting electron beams from the cathode for the first time, positive voltages are applied to the first, second, and third focusing electrodes, and the ground potential is applied to the anode (screen and phosphors), thereby raising the voltage at each gate electrode from the ground potential.

At this time, the electron beam emitted from each emitter bombards any one of the first to third focusing electrodes and flows into its power supply. In this state, the temperatures of cold cathode chips such as emitters and gate electrodes and the first to third focusing electrodes rise, and adsorbed gas molecules are emitted owing to electron bombardment on the electrodes. As a result, the degree of vacuum in the tube drops.

As the degree of vacuum in the tube drops as described above, positive ions (cations) are more readily generated due to collisions of gas molecules with electron beams, resulting in an increase in the number of positive ions generated in accordance with the degree of vacuum. The generated positive ions are accelerated toward the cathode and bombard the gate electrodes and emitters of the cathode. As a result, these component may deform. When a positive ion bombards the tip of an emitter, the tip having a radius curvature of about 10 nm may be cut to have a larger radius curvature. This may decrease the electron emission efficiency. Since this change in the shape of the tip of the emitter is an irreversible change, if the impact of positive ion bombardment in the process is strong, the resultant deterioration lasts permanently.

After a lapse of sufficient time since the emission of electrons, adsorbed gas emission is saturated or decreases. At the same time, the degree of vacuum is restored owing to the gettering effect in the tubes. For this reason, the impact of positive ion bombardment can be suppressed below an allowable degree.

Likewise, in the process of manufacturing a traveling wave tube equipped with a field emission cathode, positive ion bombardment may degrade the cathode.

SUMMARY OF THE INVENTION

The present invention has been made in consideration of the above problem in the prior art, and has as its object to provide a method of operating an electron tube which can protect an electron emission region and prevent a deterioration in emission current in the process in which the degree of vacuum in the tube does not rise sufficiently and many positive ions are generated.

In order to achieve the above object, according to the first aspect of the present invention, there is provided a method of operating an electron tube including a plurality of emitters formed on a substrate and having sharp tips; gate electrodes surrounding the plurality of emitters; and a peripheral electrode surrounding an electron emission region constituted by the plurality of emitters and the gate electrodes and insulated from the plurality of emitters and the gate electrodes; comprising: setting a voltage applied to the peripheral electrode to be lower than a voltage applied to the gate electrode, or applying a voltage lower than a voltage applied in normal operation to the peripheral electrode in the activation step of extracting an emission current from an electron emission source first and then obtaining a target emission current.

In order to achieve the above object, according to the second aspect of the present invention, there is provided a method of operating an electron tube including a plurality of emitters formed on a substrate and having sharp tips; gate electrodes surrounding the plurality of emitters; and a peripheral electrode which surrounds an electron emission region constituted by the plurality of emitters and the gate electrodes, is flush with the gate electrodes, and is insulated from the plurality of emitters and the gate electrodes; comprising: setting a voltage applied to the peripheral electrode to be lower than a voltage applied to the gate electrode, or applying a voltage lower than a voltage applied in normal operation to the peripheral electrode in the activation step of extracting an emission current from an electron emission source first and then obtaining a target emission current.

In order to achieve the above object, according to the third aspect of the present invention, there is provided a method of operating an electron tube including a plurality of emitters formed on a substrate and having sharp tips; gate electrodes surrounding the plurality of emitters; and a peripheral electrode surrounding an electron emission region constituted by the plurality of emitters and the gate electrodes and insulated from the plurality of emitters and the gate electrodes, the electron tube having a region without the emitters at a central portion of a cathode; comprising: setting a voltage applied to the peripheral electrode to be lower than a voltage applied to the gate electrode, or applying a voltage lower than a voltage applied in normal operation to the peripheral electrode in the activation step of extracting an emission current from an electron emission source first and then obtaining a target emission current.

The present invention including the above aspects has the following effect.

In the electron tube manufacturing process, no consideration needs to be given to the spot size on the screen from the step of starting electron emission to the step of obtaining a stable cathode surface state and a stable vacuum in the tube. For this reason, the potential at the peripheral electrode can be sufficiently lowered. This protects the electron emission region in the step in which the degree of vacuum in the tube does not become sufficiently high, and many positive ions are generated, thereby preventing a deterioration in emission current The above and many other objects, features and advantages of the present invention will become manifest to those skilled in the art upon making reference to the following detailed description and accompanying drawings in which preferred embodiments incorporating the principle of the present invention are shown by way of illustrative examples.

BRIEF DESCRIPTION OF TE DRAWINGS

DETAILED DESCRIPTION OF THE PREFERRED EMBODIMENTS

Several preferred embodiments of the present invention will be described below with reference to the accompanying drawings.

Figure 1A:
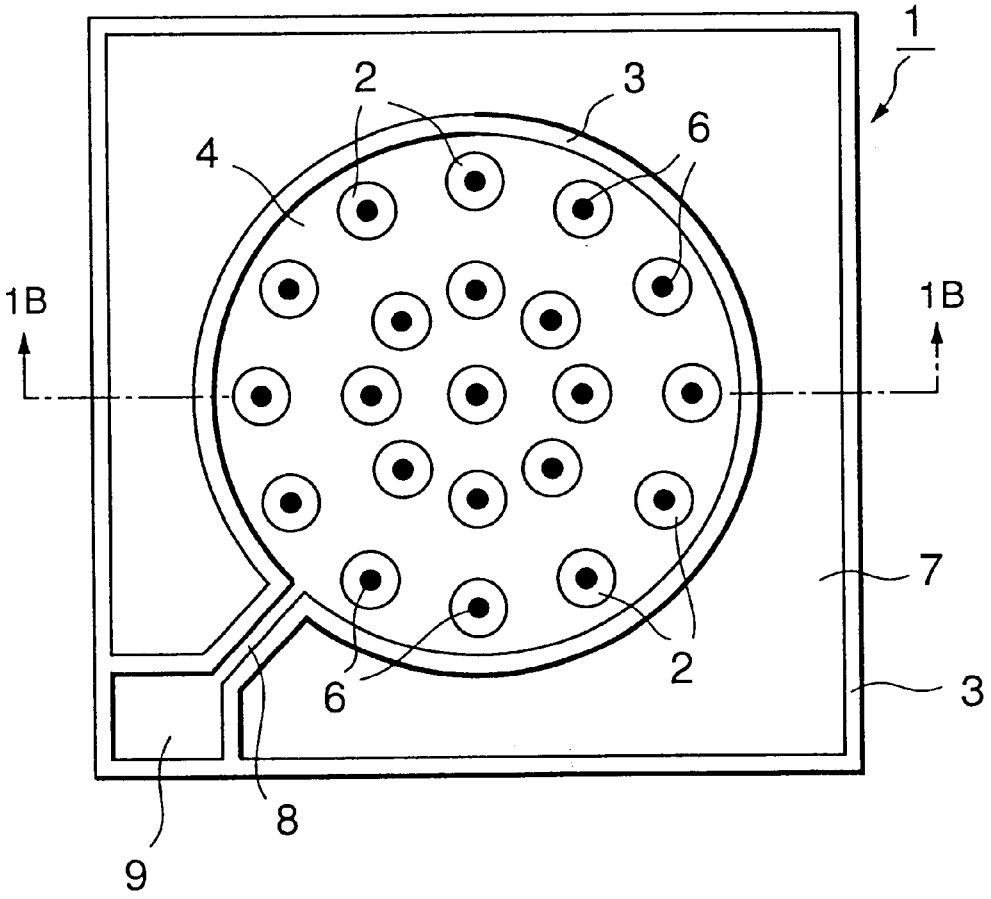
FIGS. 1A and 1B are respectively a plan view showing the structure of a field emission cathode chip in the first embodiment of the present invention and a sectional view taken along a line 1B—1B in FIG. 1A.
Figure 1B:
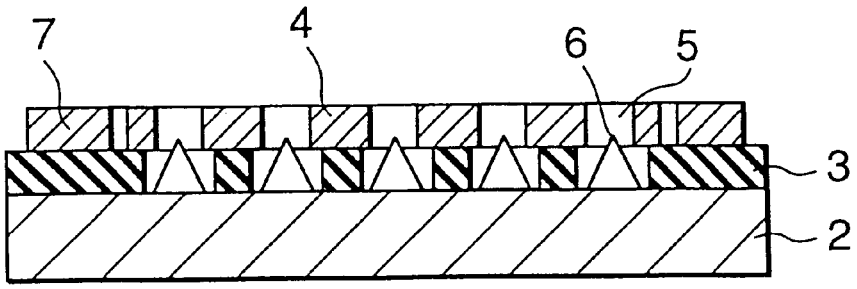

FIGS. 1A and 1B are respectively a plan view showing the structure of a field emission cathode chip in the first embodiment of the present invention and a sectional view taken along a line 1B—1B in FIG. 1A.

Figure 2:
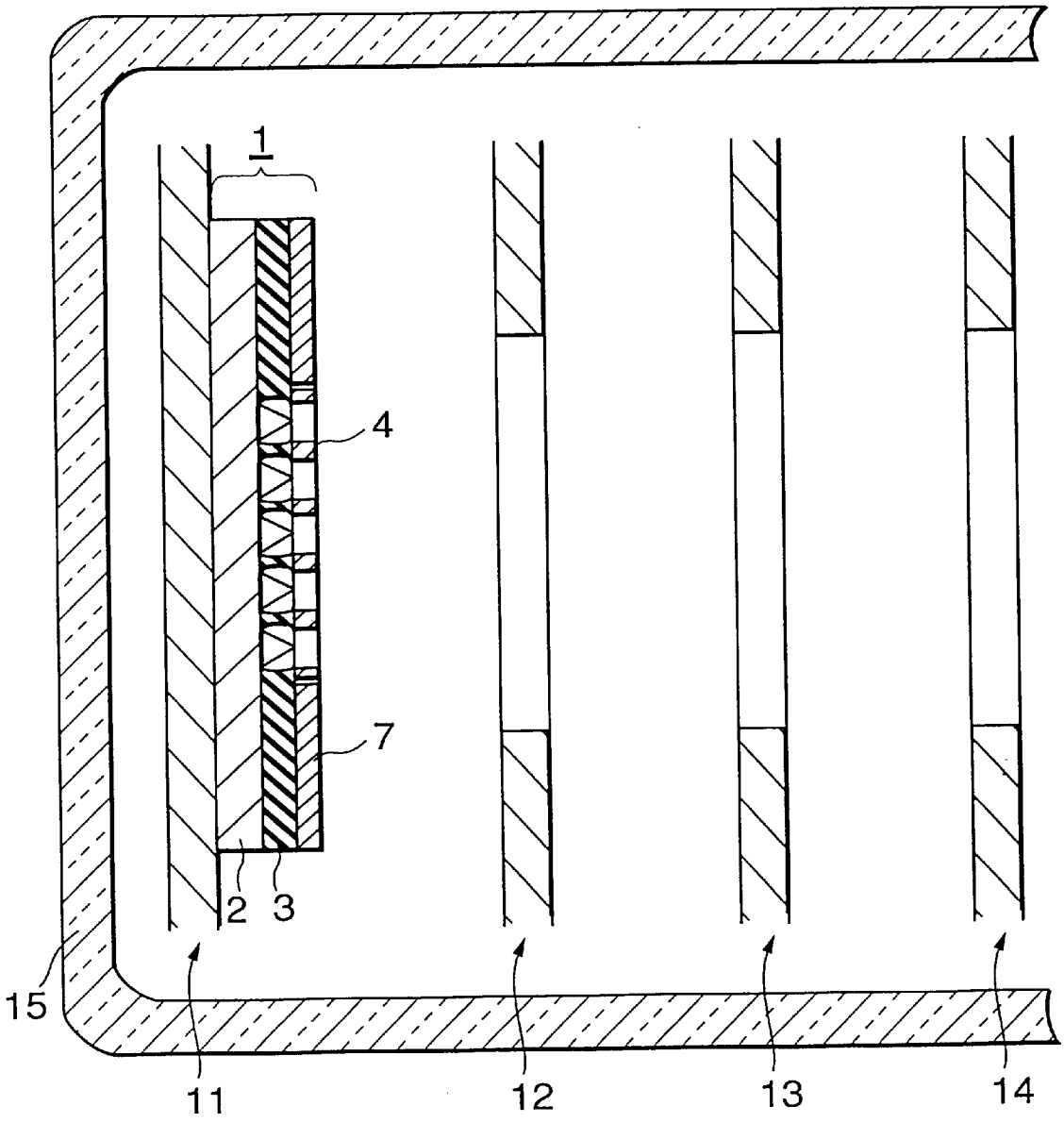
FIG. 2 is a view showing the basic structure of the electron gun portion of a cathode ray tube equipped with a field emission cathode according to the first embodiment of the present invention.

FIG. 2 is a view showing the basic structure of the electron gun portion of the cathode ray tube according to the first embodiment of the present invention.

Referring to FIGS. 1A, 1B, and 2, reference numeral 1 denotes a field emission cathode chip for emitting vacuum free electrons. The field emission cathode chip 1 is comprised of a substrate 2, an insulating layer 3, gate electrodes 4, a plurality of cavities 5 formed in both the insulating layer 3 and the gate electrodes 4, a plurality of conical emitters 6 formed on the bottoms of the respective cavities 5, a peripheral electrode 7 formed round the gate electrodes 4, an interconnection 8 for supplying currents to the gate electrodes 4, and a bonding pad 9.

As shown in FIG. 2, the field emission cathode chip 1 is mounted on a cathode electrode 11, and first, second, and third focusing electrodes 12, 13, and 14 are sequentially arranged in front of the field emission cathode chip 1. The cathode electrode 11 and the first to third focusing electrodes 12 to 14 are contained in a glass envelope 15, together with other electrodes.

Figure 3:
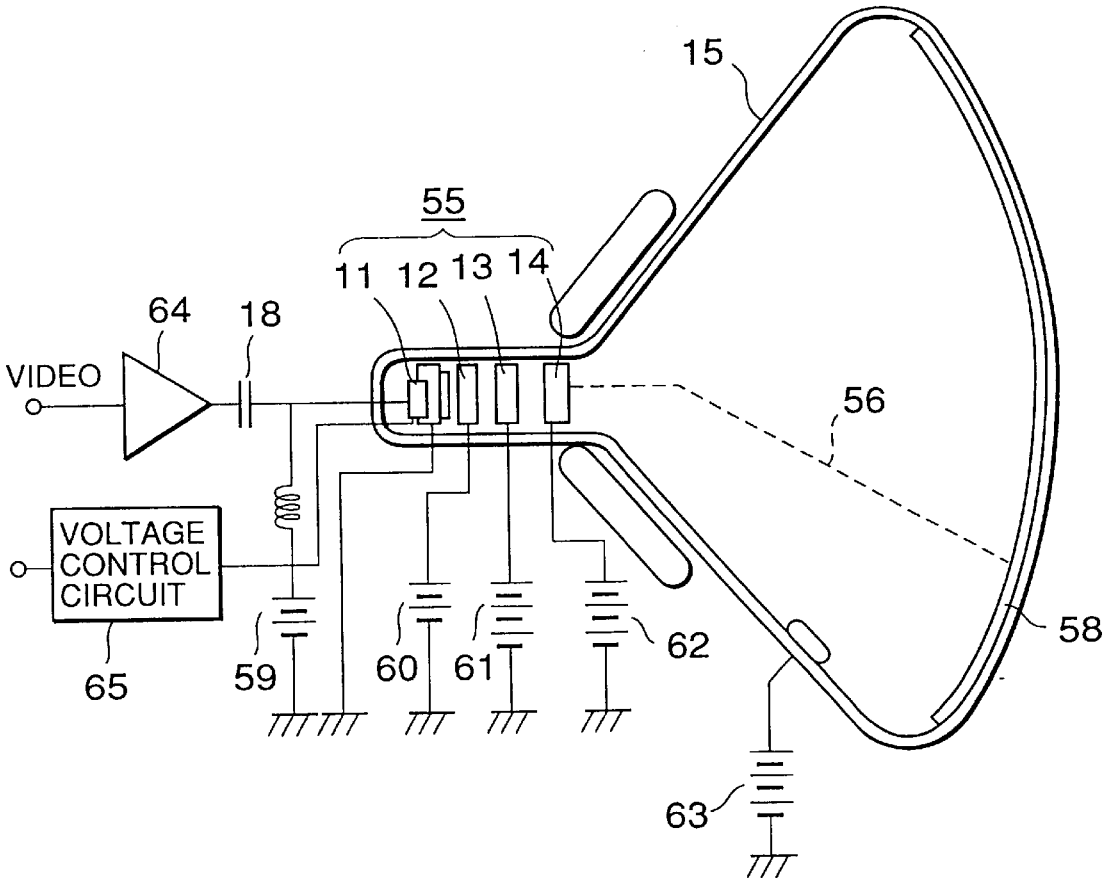
FIG. 3 is a schematic view showing the structure of the cathode ray tube according to the first embodiment of the present invention and how an external circuit is connected thereto.

FIG. 3 is a schematic view showing the structure of the cathode ray tube according to the first embodiment of the present invention and how an external circuit is connected thereto.

Referring to FIG. 3, the cathode electrode 11 and the first to third focusing electrodes 12 to 14 constitute an electron gun 55, and form electrons emitted from the tips of the emitters 6 (not shown) into an electron beam 56. Reference numeral 57 denotes a deflection yoke mounted around the glass envelope 15; 58, a phosphor; 59 to 63, DC power supplies for applying DC voltages to the electrodes of the cathode ray tube, i.e., the gate electrodes 4. the first focusing electrode 12, the second focusing electrode 13, the third focusing electrode 14, and the phosphor 58; 64, an amplifier for amplifying an input video signal; and 65, a voltage control circuit for controlling the voltage at the peripheral electrode 7.

The operation of the embodiment in FIG. 3 will be described next.

To operate the cathode ray tube in FIG. 3, the cathode electrode 11 is grounded, and positive voltages are applied to the gate electrodes 4, the first focusing electrode 12, the second focusing electrode 13, and the third focusing electrode 14. In general, a voltage lower than the voltage applied to each gate electrode 4 is applied to the peripheral electrode 7 to focus electrons emitted from an electron emission region formed by many emitters 6 so as to form an electron beam spot focused to a small diameter on the screen having the phosphor 58 stacked thereon, thus forming a small spot of lights.

Figure 4:
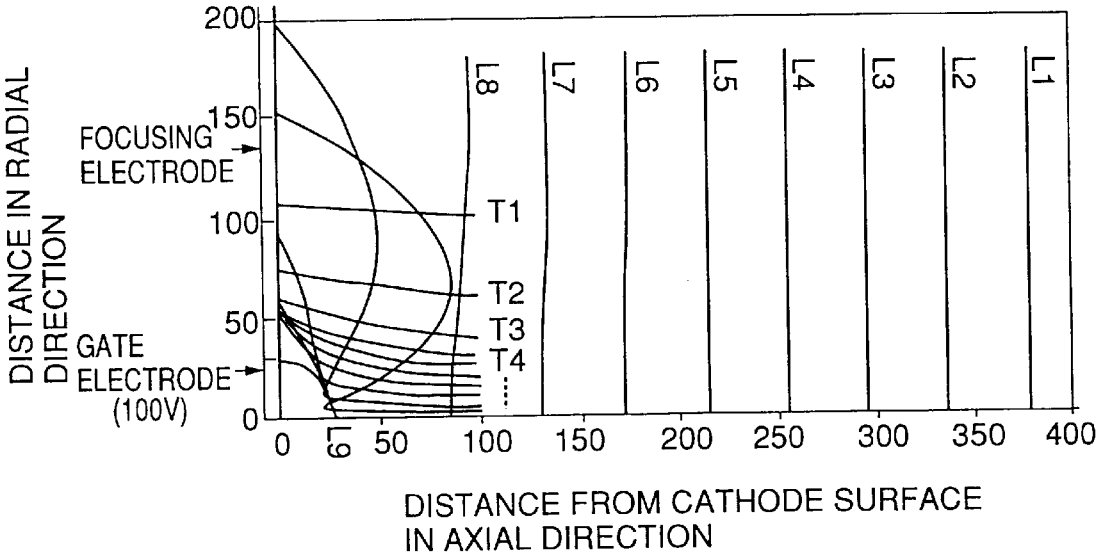
FIGS. 4 and 5 are graphs each showing an argon positive ion orbit simulation result in the form of the distance in the radial direction as a function of the distance from the cathode surface when the argon ion generation position is changed in the cathode ray tube according to the first embodiment of the present invention.
Figure 5:
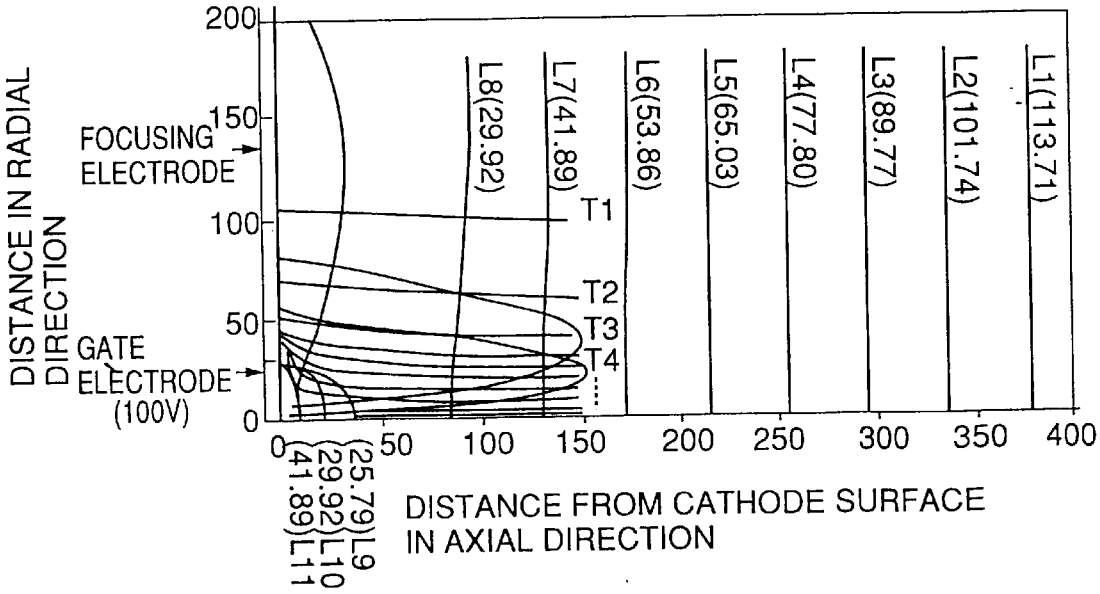

FIGS. 4 and 5 show argon positive ion orbit simulation results in the cathode ray tube equipped with the emission field cathode according to the first embodiment of the present invention.

Referring to each of FIGS. 4 and 5, the abscissa represents the distance from the central axis of the electron gun electrode structure symmetrical about the axis from the surface of the field emission cathode chip 1 in $\mu$m, and the ordinate represents the distance from the central axis in the radial direction in $\mu$m. In addition, lines L1 to L11 represent equipotential surfaces, and lines T1 to T4, . . . represent orbits of argon ions generated at a distance of 100 $\mu$m (FIG. 4) from the cathode surface and at a distance of 150 $\mu$m (FIG. 5) from the cathode surface.

Note that the range from 0 $\mu$m on the abscissa to 0 to 30 $\mu$m on the ordinate correspond to each gate electrode 4 to which a DC voltage of 100 V is applied, and the range from 0 $\mu$m on the abscissa to 31 to 300 $\mu$m on the ordinate corresponds to the focusing electrode to which 0 V is applied. In the gate electrode 4 portions, the emitters 6 to which 0 V is applied line up at 5-$\mu$m intervals. Referring to FIG. 5, the numerals in the parentheses next to L1 to L11 represent the potentials of the respective equipotential surfaces.

Argon positive ions generated at distances of 100 $\mu$m and 150 $\mu$m from the cathode surface in the direction of the central axis are first accelerated toward the cathode in accordance with a potential distribution in which equipotential surfaces are almost vertically aligned with the central axis. Since a voltage of 0 V, which is lower than the voltage applied to each gate electrode 4 at the central portion by 100 V, is applied to the peripheral electrode 7 at the peripheral portion, a potential distribution that deflects the positive ions outward is formed near the cathode. In addition, a potential distribution in which the potential rises toward each gate electrode 4 is formed in the space immediately before the gate electrode 4.

The generated positive ions are therefore repelled before they reach the cathode surface and fly to the peripheral portion. With this operation, according to the first embodiment, positive ion bombardment on the gate electrodes 4 and the emitters 6 can be prevented.

Positive ions that are deflected near the gate electrodes 4 and do not bombard them are those generated in a region where the potential is lower than the voltage (100 V) at each gate electrode 4. In the cases shown in FIGS. 4 and 5, an equipotential surface of 100 V is located near the 335th to 345th meshes, and position argon ions generated in a region closer to the cathode than this equipotential surface are repelled near the gate electrodes 4.

In the case shown in FIG. 4, positive ions are generated at positions at which the potentials are lower than those in the case shown in FIG. 5 and which are closer to the cathode than in the case in FIG. 5. For this reason, the speeds of the positive ions are low near the cathode, and the orbits of the ions are greatly deflected because the ions are greatly influenced by the potential distribution near the cathode.

As the potential difference between each gate electrode 4 and the peripheral electrode 7 increases, the cathode can be protected from positive ions generated at remoter places from the cathode surface.

FIGS. 4 and 5 show the simulation results associated with argon positive tons. However, other types of positive ions show a similar tendency even though the degree to which the orbits of positive ions are deflected by a potential distribution differs depending on the mass-to-charge ratio.

If the electrooptical system near each electron gun is designed to make the potential at each gate electrode 4 lower than that at the peripheral electrode 7, the influences of ion bombardment on the cathode can be reduced even in normal operation as well as in the electron but manufacturing process.

In the first embodiment described above, the peripheral electrode 7 and each gate electrode 4 are formed on the same insulating layer 3 to be flush with each other. However, the same effect as described above can be expected even if the peripheral electrode 7 and each gate electrode 4 are not flush with each others. If, for example, an insulating layer is stacked between the peripheral electrode 7 and the insulating layer 3 to locate the peripheral electrode 7 at a distance farther from the substrate 2 than each gate electrode 4, the influence of the potential at the peripheral electrode 7 can be enhanced. Furthermore, even if the peripheral electrode 7 is not formed on the field emission cathode chip 1 but is formed at a position away from the chip 1, the same effect as described above can be obtained.

Figure 6:
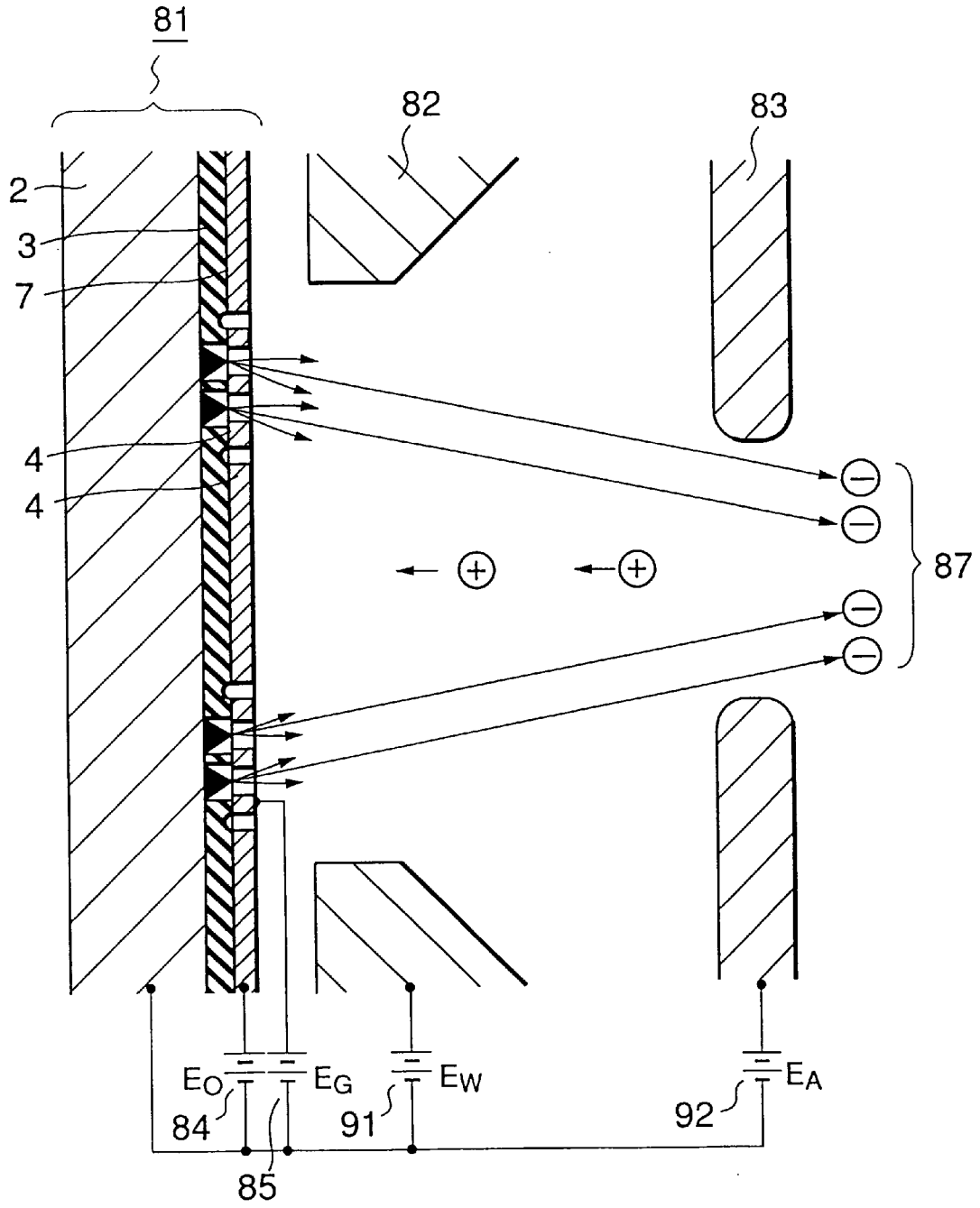
FIG. 6 is a view showing the basic structure of the electron gun portion of a traveling wave tube equipped with a field emission cathode according to the second embodiment of the present invention.

FIG. 6 shows the basic structure of the electron gun portion of a traveling wave tube equipped with a field emission cathode according to the second embodiment of the present invention.

Figure 7:
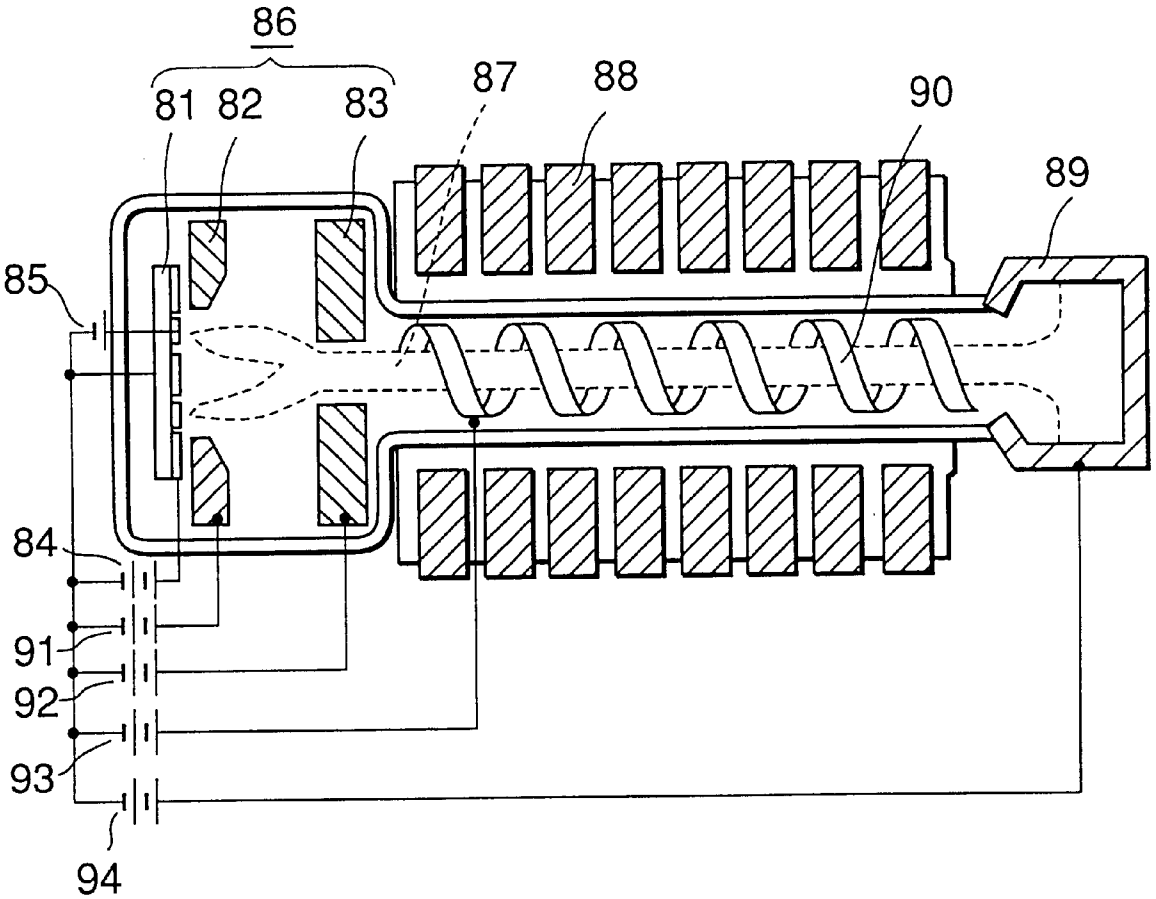
FIG. 7 is a view showing the basic structure of the electron gun portion of the traveling wave tube according to the second embodiment of the present invention.

FIG. 7 shows the basic structure of the traveling wave tube according to the second embodiment of the present invention.

Referring to FIG. 6, like the chip shown in FIG. 2, a cold cathode chip 81 is comprised of a substrate 2, an insulating layer 3, gate electrodes 4, cavities 5 formed in both the insulating layer 3 and the gate electrodes 4, conical emitters 6 formed on the bottoms of the cavities 5, and the like. Reference numeral 82 denotes a Wehnelt electrode; 83, an anode, 87, an electron beam formed by the electron gun; 84, 85, 91, and 92, a peripheral electrode power supply, a gate electrode power supply, a Wehnelt electrode power supply, and an anode power supply.

Referring to FIG. 7, reference numeral 88 denotes a periodical magnet for focusing an electron beam; 89, a collector for collecting an electron beam; 90, a helix for propagating an input microwave signal; and 93 and 94, a helix power supply and a collector power supply.

The operation of the second embodiment will be described next.

In normal operation, voltages of about 50 V, about 50 V, and several kV are respectively applied to each gate electrode 4, a peripheral electrode 7, and the Wehnelt electrode 82 to form the electron beam 87. The electron beam 87 is focused by the periodical magnet 88 and passes through the helix 90 to which several kV is applied and is collected by the collector 89 to which several kV is applied.

While the electron beam 87 passes through the helix 90, an input RF signal is amplified by the interaction with the beam. In this state, the voltages at the peripheral electrode 7 and the Wehnelt electrode 82 and the magnetic field distribution formed by the periodical magnet 88 are adjusted to make most of the electrons reach the collector 89 while preventing the electron beam 87 from striking the helix 90.

Referring to FIG. 6, a region having no emitters 6 formed at the central portion of the cathode serves to prevent positive ions mainly generated near the helix 90 from destroying the emitters at the central portion of the cathode, thus preventing a deterioration in emission and a deterioration in insulation between the emitters and the gate electrodes.

In the activation step of emitting electrons from the cathode and obtaining a stable current corresponding to a target current value, the emission current is increased while the gate voltage is raised. At this time, when the voltage at the peripheral electrode 7 and the voltage at the Wehnelt electrode 82 are set to be lower than the design voltages at the peripheral electrode 7 and Wehnelt electrode 82 in normal operation and the voltage at each gate electrode, positive ion bombardment on the electron emission region of the cathode can be suppressed.

When the voltages at the Wehnelt electrode and peripheral electrode are set to be lower than the design voltages in normal operation, the focusing effect on an electron beam from the electron gun portion may increase to increase electron beam ripples in the helix region. If the above voltages are set in this manner in the normal state, the helix current may increase. If, however, the above operation condition is set in the activation step while the helix current is observed, the adverse effect on the cathode can be eliminated without any deterioration in the electron tube in the manufacturing process.

In the case of the traveling wave tube in FIG. 6 described as the second embodiment of the present invention, since the electron emission region of the cathode has a large diameter, and the voltage at the anode 83 is high, the voltages at the peripheral electrode 7 and Wehnelt electrode 82 have little effect on the potential distribution at the electron gun portion. For this reason, the positive ion bombardment preventing effect is not so large as that in the first embodiment, but the impact of ion bombardment can be reduced.

Figure 8:
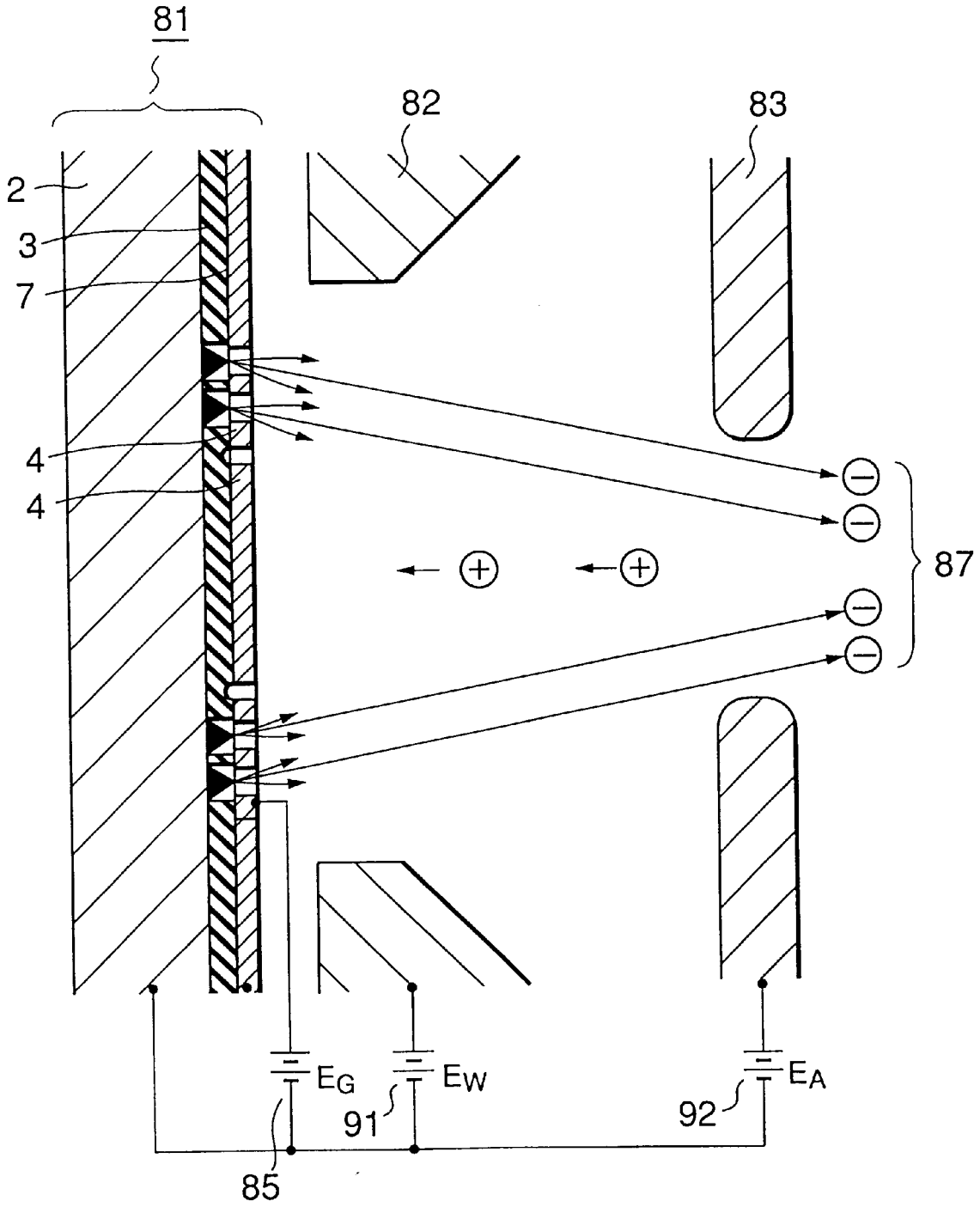
FIG. 8 is a view showing the basic structure of the electron gun portion of a traveling wave tube equipped with a field emission cathode according to the third embodiment of the present invention.

FIG. 8 shows the basic structure of the electron gun portion of a traveling wave tube equipped with a field emission cathode according to the third embodiment of the present invention.

Referring to FIG. 8, each gate electrode 4 is formed to extend near the periphery of a substrate 2 without forming any peripheral electrode, and each gate electrode 4 and a Wehnelt electrode 82 are insulated/isolated from each other through a space, insulator, or the like. In this structure, a voltage lower than that applied to each gate electrode 4 is applied to the Wehnelt electrode 82. This embodiment differs from the second embodiment in FIG. 6 in the above points. That is, in the third embodiment, a voltage lower than that applied to each gate electrode 4 is applied to each Wehnelt electrode 82 in the process of manufacturing an electron gun, as in the second embodiment.

What is claimed is:

1. A method of operating an electron tube including a plurality of emitters formed on a substrate and having sharp tips; gate electrodes surrounding said plurality of emitters; and a peripheral electrode surrounding an electron emission region constituted by said plurality of emitters and said gate electrodes and insulated from said plurality of emitters and said gate electrodes; comprising:

setting a voltage applied to said peripheral electrode to be lower than a voltage applied to said gate electrode.

2. A method of operating an electron tube including a plurality of emitters formed on a substrate and having sharp tips; gate electrodes surrounding said plurality of emitters; and a peripheral electrode which surrounds an electron emission region constituted by said plurality of emitters and said gate electrodes, is flush with said gate electrodes, and is insulated from said plurality of emitters and said gate electrodes; comprising:

setting a voltage applied to said peripheral electrode to be lower than a voltage applied to said gate electrode.

3. A method of operating an electron tube including a plurality of emitters formed on a substrate and having sharp tips; gate electrodes surrounding said plurality of emitters; and a peripheral electrode surrounding an electron emission region constituted by said plurality of emitters and said gate electrodes and insulated from said plurality of emitters and said gate electrodes; comprising:

applying a voltage lower than a voltage applied in normal operation to said peripheral electrode in the activation step of extracting an emission current from an electron emission source first and then obtaining a target emission current.

4. A method of operating an electron tube including a plurality of emitters formed on a substrate and having sharp tips; gate electrodes surrounding said plurality of emitters; and a peripheral electrode which surrounds an electron emission region constituted by said plurality of emitters and said gate electrodes, is flush with said gate electrodes, and is insulated from said plurality of emitters and said gate electrodes; comprising:

applying a voltage lower than a voltage applied in normal operation to said peripheral electrode in the activation step of extracting an emission current from an electron emission source first and then obtaining a target emission current.

5. A method of operating an electron tube including a plurality of emitters formed on a substrate and having sharp tips; gate electrodes surrounding said plurality of emitters; and a peripheral electrode surrounding an electron emission region constituted by said plurality of emitters and said gate electrodes and insulated from said plurality of emitters and said gate electrodes, said electron tube having a region without said plurality of emitters at a central portion of a cathode; comprising:

setting a voltage applied to said peripheral electrode to be lower than a voltage applied to said gate electrode.

6. A method of operating an electron tube including a plurality of emitters formed on a substrate and having sharp tips; gate electrodes surrounding said plurality of emitters; and a peripheral electrode surrounding an electron emission region constituted by said plurality of emitters and said gate electrodes and insulated from said plurality of emitters and said gate electrodes, said electron tube having a region without said plurality of emitters at a central portion of a cathode; comprising:

applying a voltage lower than a voltage applied in normal operation to said peripheral electrode in the activation step of extracting an emission current from an electron emission source first and then obtaining a target emission current.

* * * * *